United States Patent [19]

Böhm et al.

[11] Patent Number: 4,963,251

[45] Date of Patent: Oct. 16, 1990

[54] APPARATUS FOR SORTING AND DISTRIBUTING MAIL PIECES

[75] Inventors: Günter Böhm, Bonn; Jürgen Schieleit, Dortmund; Detlev Braun, Hattingen; Heinz-Georg Pater, Ense-Vierhausen; Heinz Köbbing, Dortmund; Hubert Büchter, Ahlen, all of Fed. Rep. of Germany

[73] Assignee: Fraunhofer-Gesellschaft zur Förderung der Angewandten Forschung e.V.

[21] Appl. No.: 245,128

[22] Filed: Sep. 15, 1988

[30] Foreign Application Priority Data

Sep. 19, 1987 [DE] Fed. Rep. of Germany ..... 3731589

[51] Int. Cl.[5] ..... B07C 3/08

[52] U.S. Cl. ..... 209/564; 209/584; 209/900; 198/365

[58] Field of Search ..... 209/552, 563, 564, 584, 209/900; 198/465.1, 465.2, 803.01, 365, 476.1, 477.1, 485.1, 486.1, 802; 414/788.1, 788.4, 788.7, 792.7, 793.8

[56] References Cited

U.S. PATENT DOCUMENTS

| | | | |
|---|---|---|---|
| 1,442,126 | 1/1923 | Cadden | 198/365 X |
| 2,689,657 | 9/1954 | Lens | 198/365 |
| 3,414,138 | 12/1968 | Junemann et al. | 414/793.8 |
| 3,759,381 | 9/1973 | Mercadie et al. | 209/900 X |
| 3,884,370 | 5/1975 | Bradshaw et al. | 209/900 X |
| 4,008,813 | 2/1977 | Leersnijder | 209/900 X |
| 4,310,276 | 1/1982 | Castagnoli | 209/900 X |

FOREIGN PATENT DOCUMENTS

| | | | |
|---|---|---|---|
| 1153359 | 3/1958 | France | 209/900 |
| 0614388 | 12/1960 | Italy | 209/900 |
| 0084749 | 5/1957 | Netherlands | 209/900 |

*Primary Examiner*—Margaret A. Focarino
*Assistant Examiner*—Edward M. Wacyra
*Attorney, Agent, or Firm*—Toren, McGeady & Associates

[57] ABSTRACT

In an apparatus for sorting and distributing mail pieces, the mail pieces are introduced into an inlet module, then from the inlet module into a transporter and finally to an outlet module. Mail pieces are moved from a receiving station on to a continuous conveyor forming a part of the inlet module. The continuous conveyor has a number of transporting sections disposed in spaced generally horizontal planes. From the transporting sections mail pieces are transferred at a transfer station from transport pallets on to individual receptacles in the transporter. At a removal station spaced from the transfer station, mail pieces are removed by an extraction device from the individual receptacles on the transporter to containers on an output conveyor of the output module. The containers are formed to receive a plurality of mail pieces.

22 Claims, 11 Drawing Sheets

APPARATUS FOR SORTING AND DISTRIBUTING MAIL PIECES

BACKGROUND OF THE INVENTION

The present invention is directed to an apparatus for sorting and distributing mail pieces, such as letter mail, made up of an input module for the mail pieces, a transporter for moving individual mail pieces between the input module and an output module for the sorted mail pieces.

A known problem with so-called letter mail is that the type of sorting and distribution of such mail pieces is very costly, particularly in terms of personnel, whether the distribution and allocation refers to individual cities and villages or to the distribution and allocation to individual streets and other receivers within the cities and villages.

Mail distributing systems are known where mail pieces, particularly letters, are directed into individual compartments via belt conveyors after presorting and subsequent sorting. A letter placed into the system is provided with a code, the code is read at a corresponding place in the system, and the letter is then assigned to an indiVidual compartment by distributing conveying means. The following German patent No. DE-C-32 05 652 is referred to only as an example.

The known solution is suitable only for standard letter formats, as a rule, differences in size, thickness, and dimensioning can not be processed in such a system. Further, such a system is completely unsuitable for mailing periodicals, printed matter and the like.

SUMMARY OF THE INVENTION

Therefore, it is the primary object of the present invention to sort completely a collection of heterogeneous mail pieces and to assemble them in a sorted form where a rough sorting, as well as a detailed sorting, is possible in the same system or apparatus The apparatus is made up of an input module for receiving the mail pieces, and an output module for collecting the sorted mail with a transporter moving the mail pieces between the input module and the output module. The input module includes a continuous conveyor for receiving mail pieces at a receiving station from singulators or separators. The continuous conveyor includes a plurality of horizontally arranged vertically spaced transporting planes for directing the mail pieces into the transporter. The transporter comprises a multiplicity of circulating individual transporting units or receptacles. Transport pallets on the continuous conveyor of the input module also form transfer elements for placing the mail pieces from the pallets into assigned individual receptacles of the transporter. At least one extracting device is located on the transporter spaced from the transfer station for extracting or removing the mail pieces from the transporter and placing them in a conveyor in the output module where the mail pieces are collected in containers.

In the invention, the sorting operation including transporting the sorted mail pieces, is provided in a transporter which is as independent as possible from the items being transported, that is, the format, weight, dimensions of the mail pieces need not be taken into account.

From a supply container, which can be comparable to a container available at the outlet end of the system, each mail piece is fed from a separator to a continuous conveyor provided with forked pallets. The position of a mail piece can be determined at any time by a corresponding coding device. The mail piece, supplied to the continuous conveyor is then conveyed so that it is sorted from the individual pallets of the continuous conveyor to a collecting container with a transporter in the form of an individual conveying means forming an intermediate part of the apparatus.

The equipment at the receiving station for transferring a mail piece onto the inlet module includes a gripping device with a wiping device. In addition, an oscillating drive and/or so-called format baffle plates can be provided for ensuring a certain pre-sorting according to size by mechanical means using size templates in a sloped position of the container or pallet receiving the unsorted mail pieces.

It may be advisable if a combined pneumatic and mechanical gripping device is used for picking up the upper mail pieces, that, for example, the upper mail piece is drawn off or raised from the stack by only a short distance using the pneumatic conveyor whereby it can be completely gripped by the mechanical gripping device Such an arrangement has the advantage that the pneumatic gripping device need only expend a slight force, since it is not necessary for it to transport the total weight of the mail piece.

Different suction grippers can be controlled based on information from a format and thickness detection device of the system, that is, only as many suction grippers are activated and controlled as are necessary based on the letter size to be gripped.

It is also advisable to construct the carriers for the individual mail pieces as forked pallets, that is, the individual mail pieces are deposited on an individual fork or forked cage. With such an arrangement, it is advantageous to arrange the fork or forked cage as part of a transporting pallet movable around at least two different axes.

Further, it is advantageous if the transporter receiving mail pieces from the input module is in the form of a continuous conveyor provided with a multiplicity of individual receiving positions each formed as a forked receiver with the conveyor being a substantially oval shaped multi-tier circulating conveyor, for example, with one thousand receiving positions. To deposit individual mail pieces in the individual tiers in a synchronous manner, at least one synchronizing member is provided in the input module. The continuous conveyor of the input module includes a multi-loop path made up of a plurality of interconnected transporting sections with each section being approximately in a horizontal plane with the individual planes spaced apart in the vertical direction. The multiple loop-like transporting sections for the forked pallets is advantageous to provide the transfer of the mail pieces to the individual tiers of the transporter conveyor.

To remove the mail pieces from the fork support or basket on the transporter conveyor, a removal device is provided which is also equipped with fork arms. The fork arms can take a mail piece from the fork baskets on the transporter conveyor and direct it into a collecting container in the output module Dividing the transporter conveyor into a plurality of vertically spaced tiers permits the formation of zones, each with approximately four tiers, which can be covered by a vertically movable extracting device, affording one extracting device for processing the mail in four tiers of one zone.

The apparatus involving the present invention is coupled with an electronic data processing system which carries out all of the distributing and control operations.

Such control operations range from the possible coding and detection of individual mail pieces to the positioning of the individual forked pallets on the input module conveyor, the transfer from the input module into the transporter conveyor and the subsequent removal or extraction from the transporter conveyor into a receiving container in the output module. The coding and distribution can lead to a further processing, possibly to a further pass through the apparatus for a more detailed sorting of the mail pieces.

Control of the apparatus can be effected so that preliminary depositing is carried out during introduction onto the transporter conveyor whereby the individual extracting devices do not have to move over any distanoe in effecting a sorting process. The preliminary distribution can be performed so that a given destination is placed in a tier of the transporter conveyor. The extracting device can then be operated in one position.

The following advantages can be obtained by using suitable software: a high average throughput, processing of peak loads by means of buffers, and a high availability by using parallel apparatus and particularly effecting exchangeability of the individual system elements by utilizing individual modules. The possibility of selecting the number of operational planes and the number of modules is particularly advantageous so that the system can be tailored for each application. Automatic load adaptation and frictionless operation can be achieved with corresponding software during outages of portions of the system.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 3 is a perspective view of a separating or receiving station;

FIG. 4 is an enlarged detail view of the encircled section Z of FIG. 3;

FIG. 5 is a perspective view of a forked pallet on the input module conveyor;

FIG. 6 is a coding station with two forked pallets as shown in FIG. 5;

FIG. 7 is a perspective view displaying the synchronization and transfer between the input module conveyor and the transporter conveyor with the transport effected by forked pallets;

FIG. 8 is a schematic plan view of the transporter conveyor taken in the direction of the arrow VIII in FIG. 9;

FIG. 9 is a schematic side view of the transporter conveyor;

FIG. 10 is a partial elevational view illustrating the transfer from the transporter conveyor to the output module viewed in the direction of the arrow X in FIG. 11;

FIG. 11 is an elevational view of the device shown in FIG. 10 including a part of the transporter conveyor;

FIGS. 12 and 13 are detailed views of the transfer device between the transporter conveyor and the output module conveyor as shown in FIGS. 10 and 11;

FIG. 14 is a plan view of an outlet module conveyor; and

DETAILED DESCRIPTION OF THE INVENTION

Figure 1:
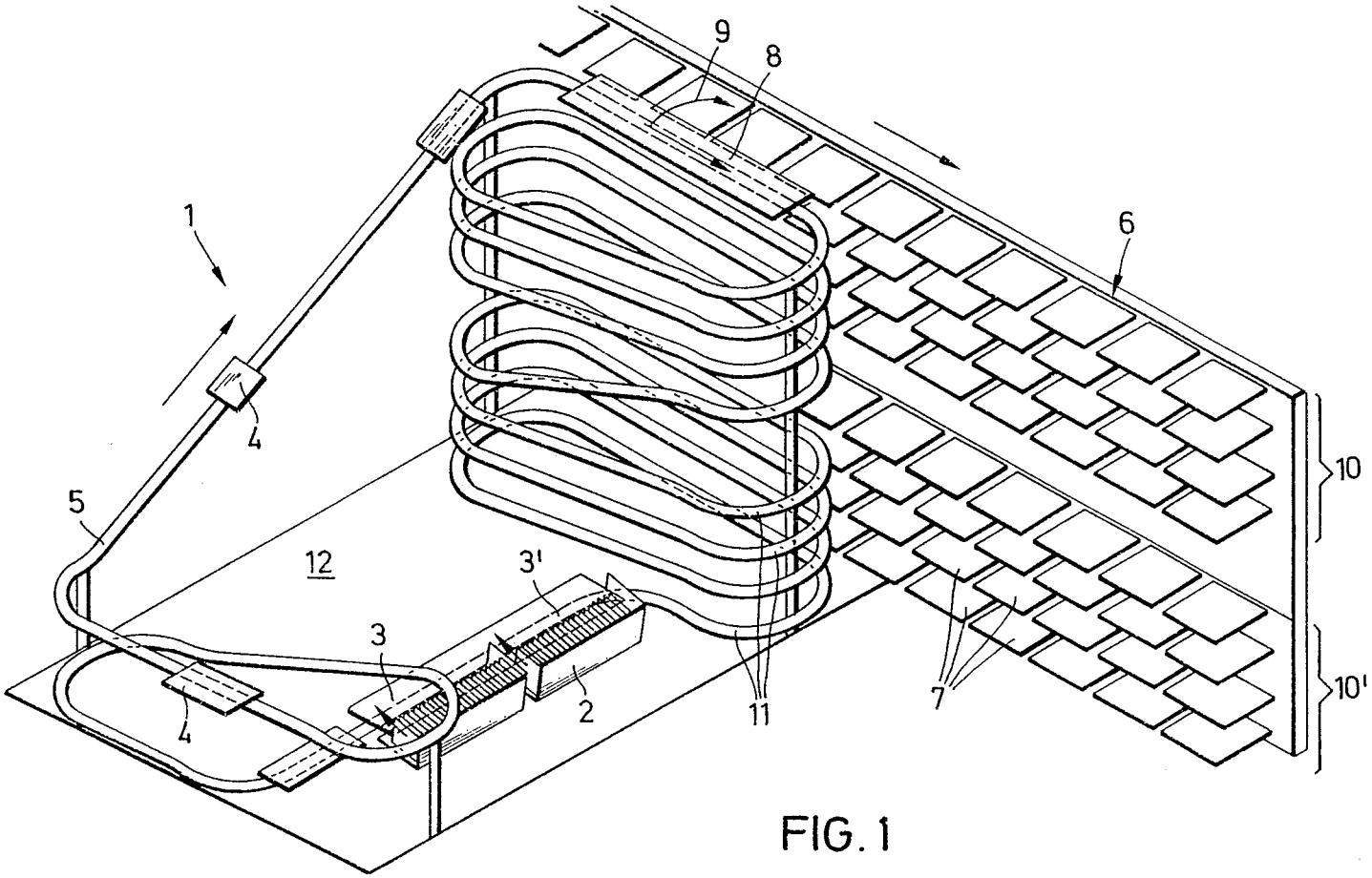
FIG. 1 is a perspective view of the input section of the apparatus embodying the present invention.
Figure 2:
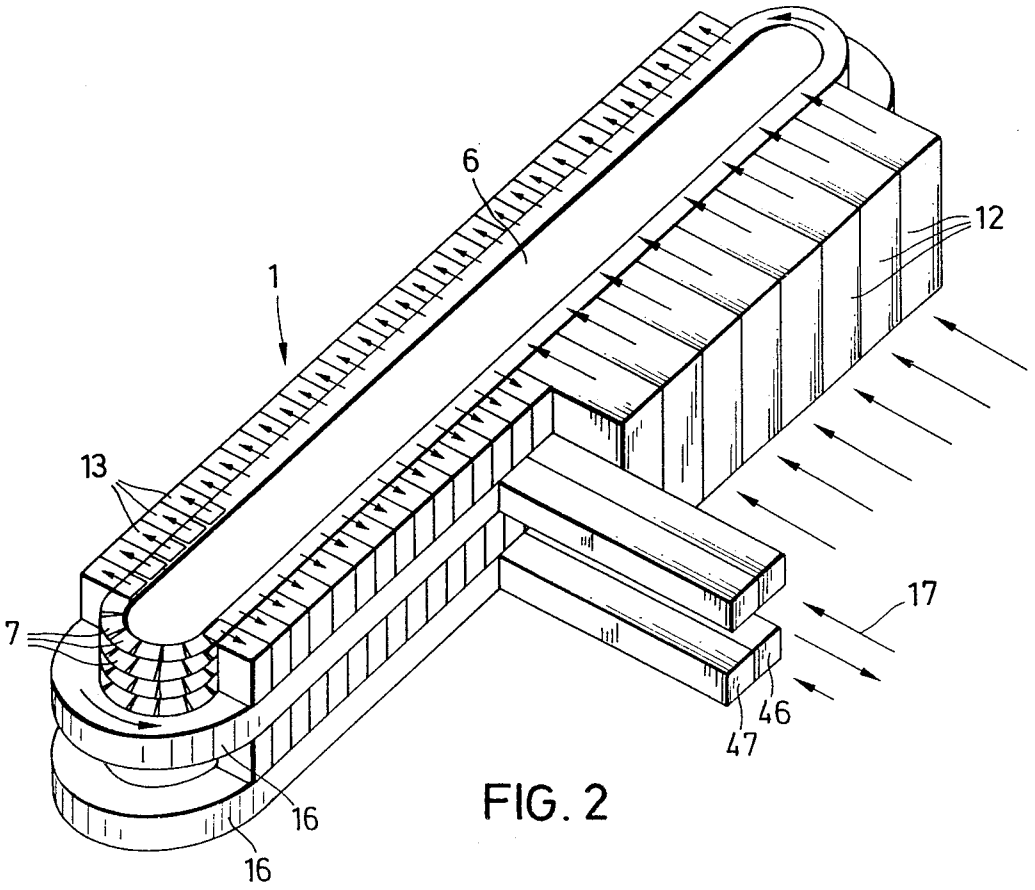
FIG. 2 is a perspective and somewhat schematic view of the apparatus on a reduced scale.

The main parts of the apparatus 1 are illustrated in FIGS. 1 and 2.

To sort mail pieces, not set forth in more detail, the mail pieces are delivered in pallets 2 and are placed in a receiving or separating station 3, with two separating stations 3, 3' shown in FIG. 1. The mail pieces are moved from the separating station, described in more detail below, on to individual transport pallets 4 which are transported to a transporter conveyor 6 by an individual mail piece conveyor 5.

As displayed in FIG. 2 transport conveyor 6 is a circulating continuous conveyor with a plurality of individual receptacles 7 for individual mail pieces. To provide synchronization between the transporter conveyor 6 and the individual mail piece conveyor 5, at least one synchronization unit 8 is provided with the transfer operation between the two conveyors indicated in FIG. 1 by the arrow 9.

As can be seen in FIG. 1, the continuous conveyor 6 of the transporter has a plurality of receptacle planes extending horizontally and spaced apart vertically with each plane equipped with a number of individual receptacles 7. The receptacle planes are arranged in two groups 10, 10' each containing four tiers of the receptacle planes. To provide transfer from the individual mail piece conveyor 5 into the transporter continuous conveyor 6 the conveyor 5 is formed with a plurality of horizontally arranged vertically spaced conveyor loops 11 so that the individual mail pieces can be aligned opposite each of the tiers of the receptacle groups so that the mail pieces can be transferred in a synchronized manner.

To facilitate the description, the devices 3, 3' in the receiving or separating station 3, the pallets 4, the individual mail piece conveyor 5 with the synchronization unit 8 and the transfer loops 11 of the conveyor are designated as an input module 12. In FIG. 2 a plurality of input modules 12 are shown arranged in parallel with one another. The input of the mail pieces into the apparatus is shown by the arrows for each of the input modules. At another location of the intermediate transporter there is a plurality of output modules 13, note FIG. 12, located adjacent to the transporter conveyor 6. The transporter conveyor 6 has a multiplicity of individual receptacles, there may be one thousand individual receptacles per conveyor.

The output modules 13 receive the individual mail pieces located in the individual receptacles 7 in the transporter conveyor 6 and place them in containers 15 for the mail pieces. When the containers 15 are filled, they are carried by an output module conveyor 16 located at the lower end of each group of tiers 10, 10', shown in FIG. 2. Empty containers to receive mail pieces are also introduced to the apparatus by the same output module conveyors 16. The movement of the containers into and out of the output module is shown by the arrows 17 in FIG. 2.

Figure 4:
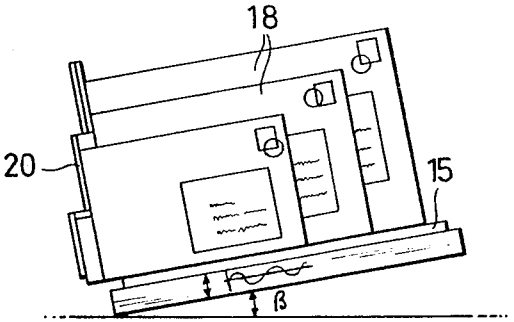
FIGS. 3 to 14 illustrate parts of the apparatus on different scales, that is
Figure 3:
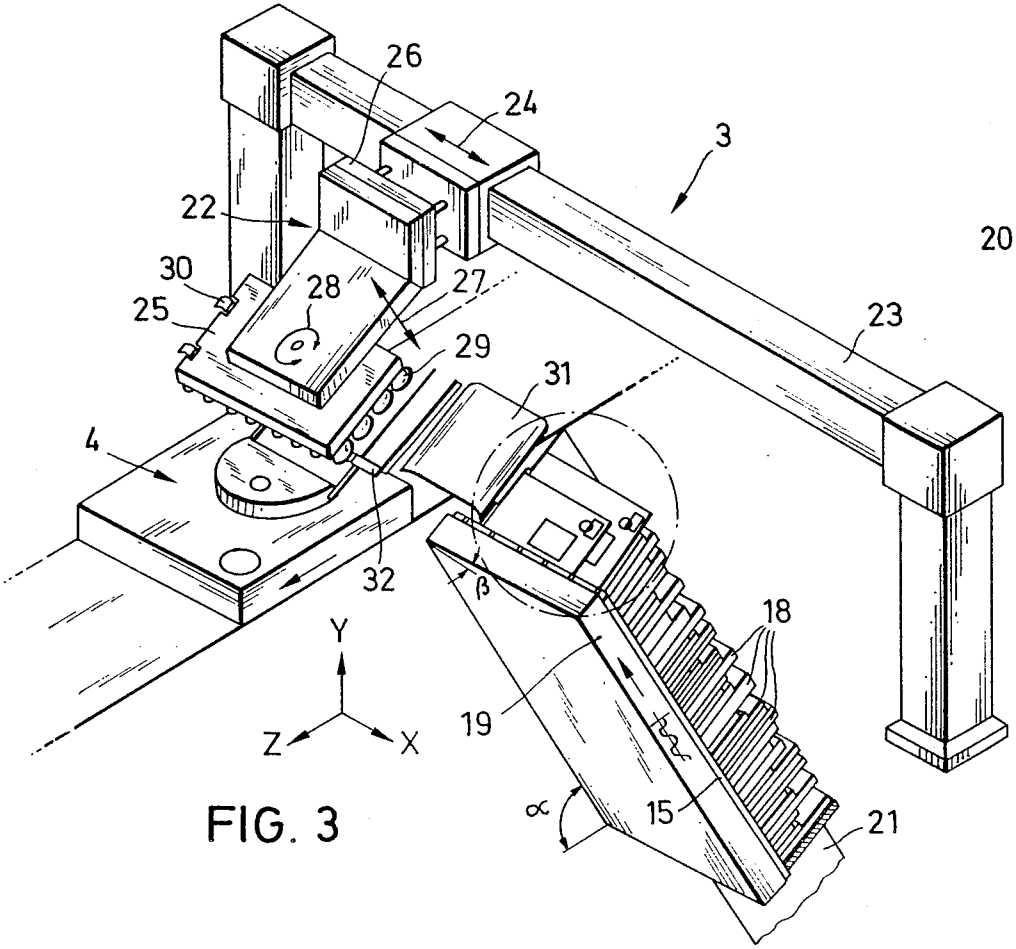

Details of the separating station 3 are displayed in FIGS. 3 and 4. A pallet 2, shown by the reference numeral 18 in FIG. 3, forms a container 15 for mail pieces and is loaded with mail pieces of different sizes and thickness and is mounted on a vibrating table 19 and is maintained in a special angular position as indicated in FIGS. 3 and 4. One side of the vibrating table 19 is equipped with format baffle plates 20, note FIG. 4, offset in a stepwise manner for accepting mail pieces at different depths, note FIG. 4, and this arrangement has particular advantages for optical detection devices not shown in any detail.

To remove the upper mail piece out of the container 15 it is lifted in an upward direction by an advancing means 21, not shown in greater detail, and a gripping device 22 is provided movable on the portal frame 23 in the direction of the double arrow 24. The gripping device 22 has a gripping plate 25 on a support 26 which can be moved in the direction of the double arrow 27 and can also be pivoted as indicated by the double arrow 28. The gripping plate 25 has a plurality of suction cups 29 on its underside and the gripping plate also has mechanical grippers 30 not shown in detail, at one end of the plate.

Gripping device 22 works in the following manner: after automatic format detection of the upper mail piece, the support 26 with the gripping plate 25 are moved over the mail piece with the activation of as many suction cups 29 as required to correspond to the size and weight of the letter or mail piece. Gripping device then moves the upper mail piece over a supporting and wiping mechanism 31 for completely gripping the mail piece by mechanical grippers 30. Accordingly, the suction cups 29 need only apply a slight output for the required lateral thrust. The mail piece is then placed on a carrying fork 32 forming a part of the transporting pallets 4 with the fork being pivotally movable around at least two separate axes.

Figure 5:
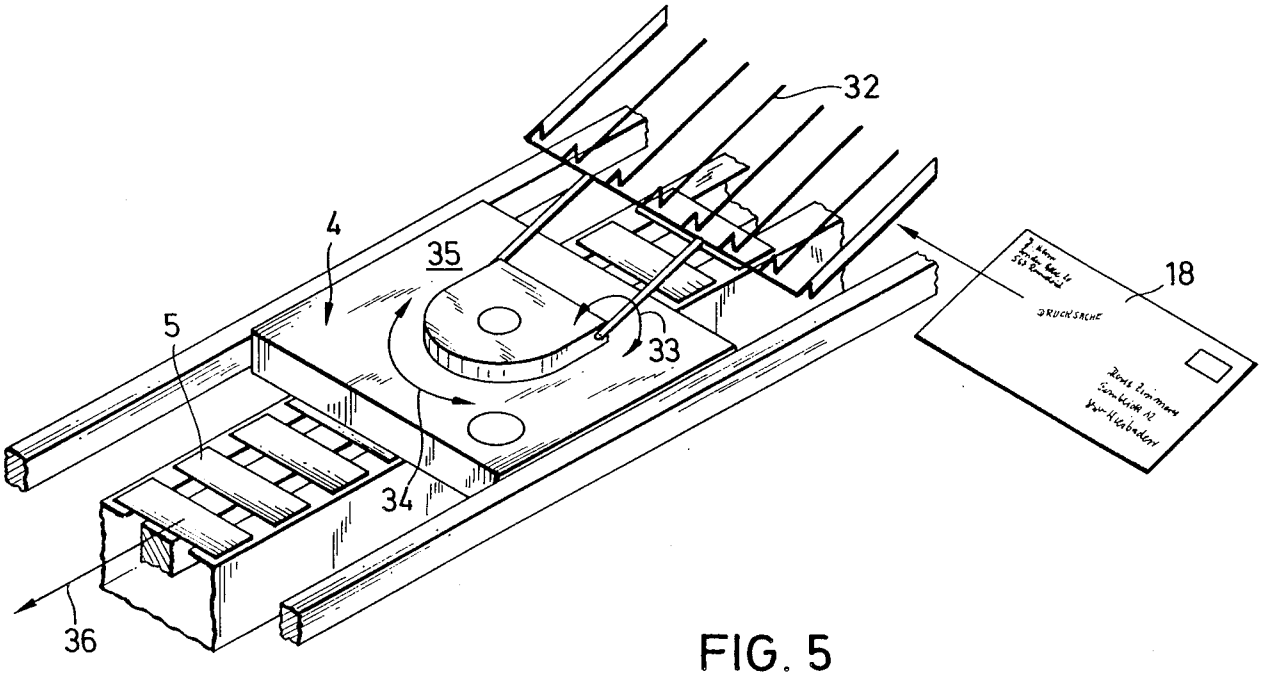
Figure 6:
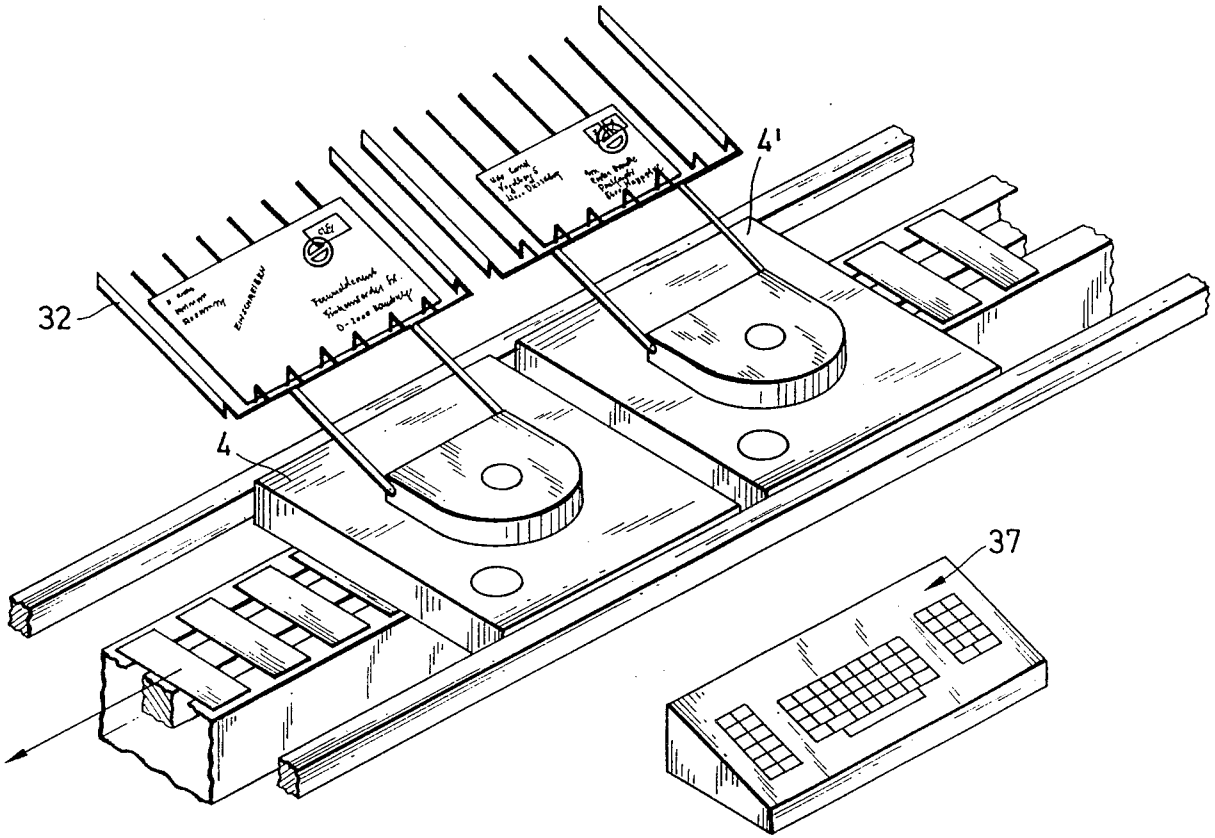

Transporting pallet 4 is set forth in more detail in FIG. 5. Transporting pallet 4 is also characterized as a forked pallet since it is equipped with the carrying fork 32 which, as mentioned above, is pivotally movable about at least two axes indicated in FIG. 5 by the double arrows 33, 34. Base 35 of the forked pallet is mounted on the input module conveyor 5. Carrying fork 32 can be pivoted out of the travelling direction, as shown by the arrow 36, in an outward direction by a corresponding control means, for example, for the purpose of coding, as indicated in FIG. 6. For coding the fork 32 is pivoted so that the mail piece is positioned in front of a coding station where it can be read. At the coding station, a person inputs the destination of the mail piece using a coding device 37 note FIG. 6. It should be noted that it is not necessary for the letter itself to be coded, since the coding information can be assigned directly to the forked pallets 4, 4' and to the other parts of the apparatus or system. The detection of the transported mail piece is possible by means of the individual transport.

Figure 7:
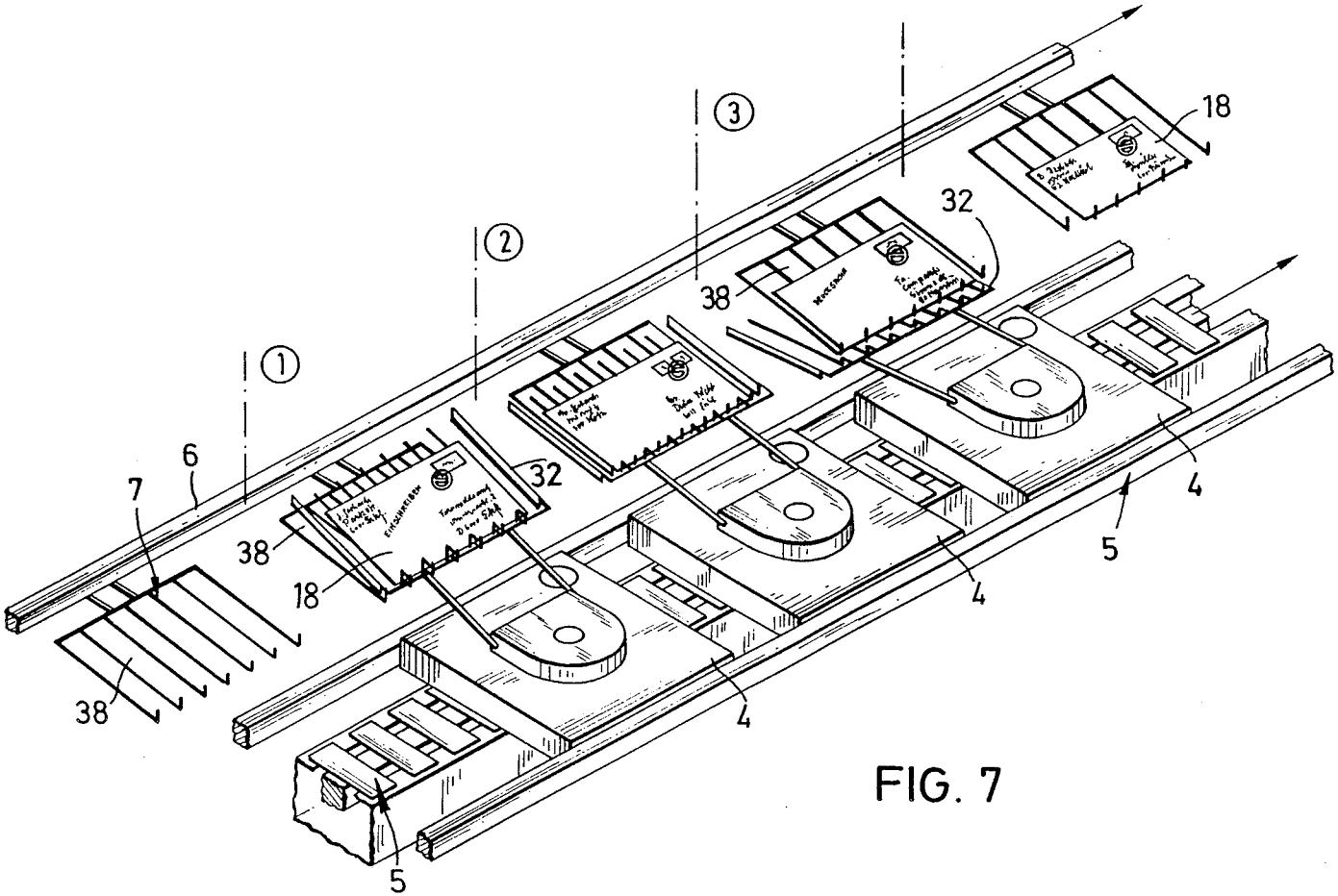

In FIG. 7 the transfer station of the mail pieces from the forked pallets 4 of the input module to the individual receptacles 7 in the transporter conveyor 6, is depicted. The individual receptacles 7 are also formed in a fork-like manner as indicated in FIG. 7. The speed of the forked pallets corresponds to that of the individual receptacles by means of the synchronization unit 8 in the input module. In the transfer operation, the fork 32 pivots downwardly with the mail piece 18 so that it moves through the forked basket 38 of the individual receptacles 7 with the first part of the pivoting operation being displayed by the circled portion 1 in FIG. 7. The exact transfer is exhibited in FIG. 7 by the circled position 2 and with the further downward pivotal movement of the fork 32 the mail piece 18 is deposited in the forked basket 38 as displayed by the circled position 3 in FIG. 7.

Figure 8:
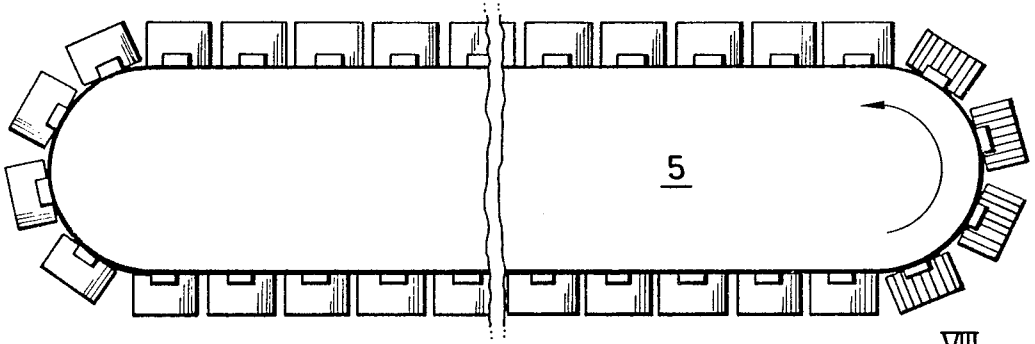
Figure 9:
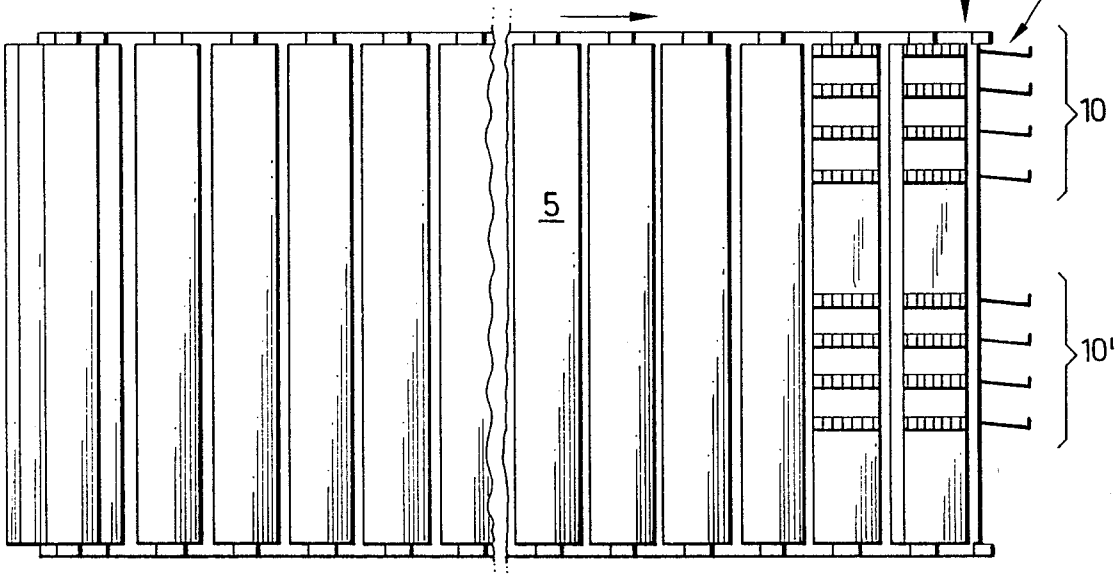
Figure 11:
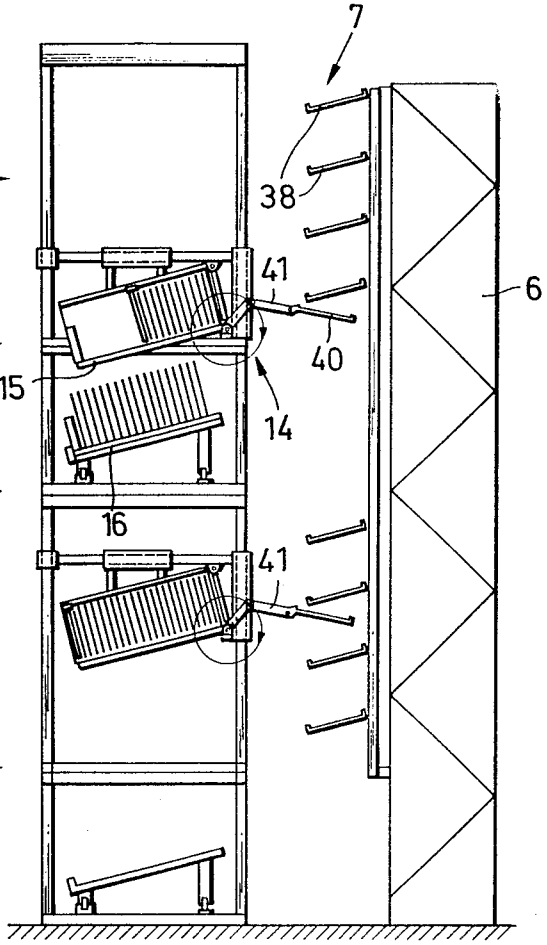
Figure 10:
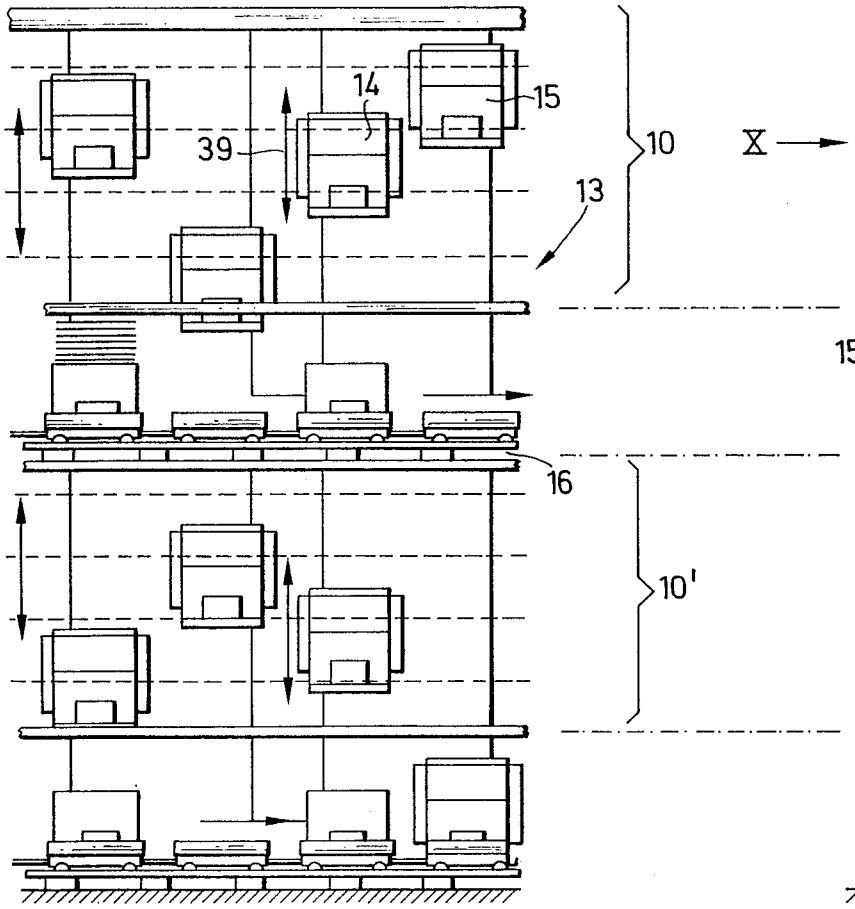

In FIGS. 8 and 9 the transporter conveyor 6 located between the input module and the output module, is illustrated as a continuous conveyor with a plurality of tiers of individual receptacles 7 combined to form the tier units 10, 10'. In the plan view of FIG. 14 output module conveyor 16 is shown and located below the tier units 10, 10' in FIGS. 8 and 9. According to the height, length and filling density, it can be noted that transporter conveyor 6 can be equipped with a multiplicity of individual receptacle 7 from which a mail piece can be removed individually. An extracting device forming a part of the output module 13, is set forth in more detail in FIGS. 10 to 13. The output modules include vertically movable extraction devices 14 movable in the direction of the double arrows 39 in FIG. 10. A container 15 for mail pieces is assigned to each of the extracting devices 14. If a container is full, it is placed on the conveyor 16 and an empty conveyor is supplied to the extracting device.

Figure 12:
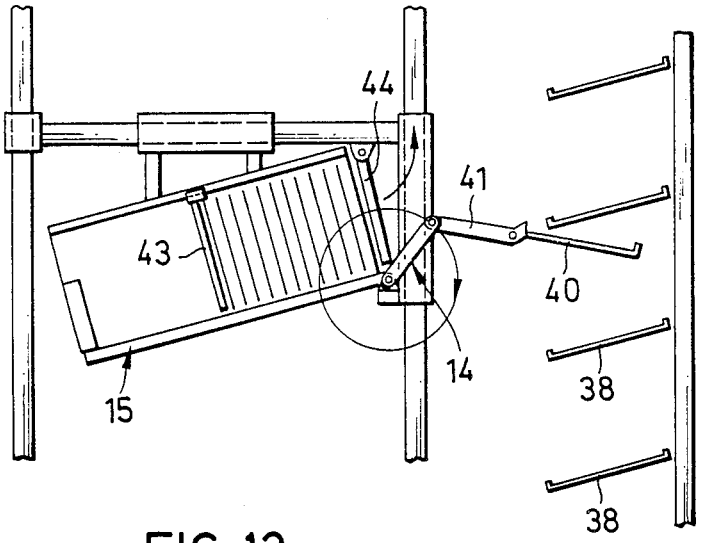
Figure 13:
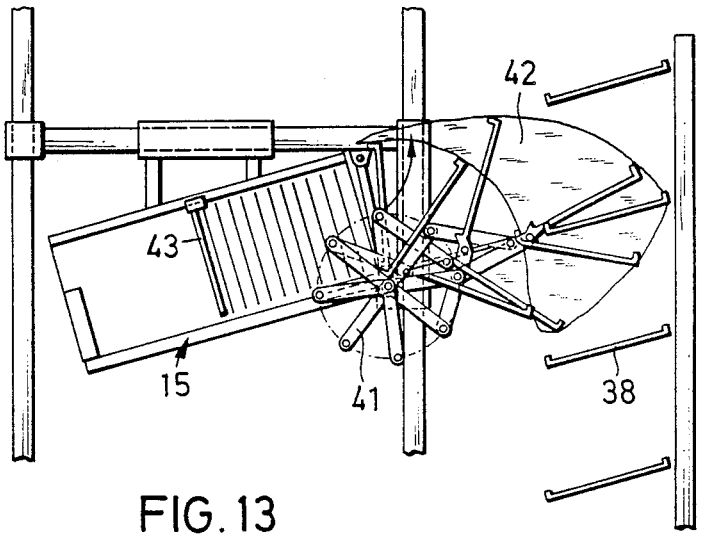

The extraction or removal of the mail pieces is explained briefly with reference to FIGS. 12 and 13: The extraction device 14 includes a forked gripper 40 secured to and extending outwardly from a crank gear 41. As mentioned above, the forked gripper is movable in the vertical direction. This feature of its movability means that the extracting operation is not performed in synchronization with the moving continuous conveyor 6 of the transporter, instead it is carried out in as short a time as required to swing through and empty a corresponding receptacle 7. The movement of the extracting device 41 relative to the receptacle 7 is indicated by the shaded portion 42 in FIG. 13. The mail piece in the forked basket 38 of the receptacle 7 is lifted by the forked gripper or fork 40 in a very rapid movement so that it remains positioned on the fork. The fork 40 then carries the mail piece upwardly and in a rotational movement deposits it against a displaceable rear wall 43 of the container 15 for the mail pieces. Rear wall 43 is displaceable in a synchronous manner in accordance with the filling state of the container 15. A stop or baffle plate 44 is provided at the end of the receptacle adjacent the extracting device 14 and prevents mailing pieces from falling out of the front of the container and swivels in a reciprocating motion upwardly and then downwardly in a synchronous manner when the mail pieces are read.

Figure 14:
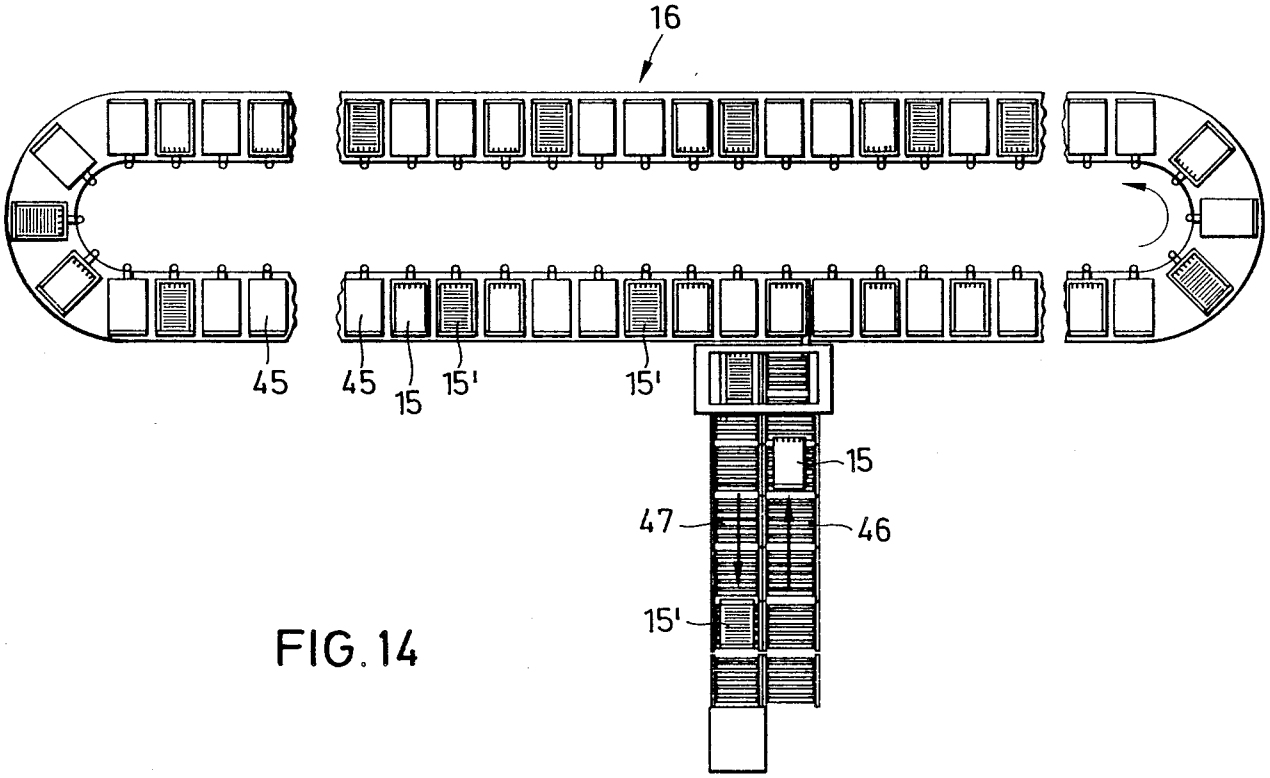

In FIG. 14 a plan view is shown of the output module conveyor 16 with empty position 45, empty containers 15 for mail pieces, and filled containers 15' for mail pieces. Empty containers 15 are supplied to the conveyor 16 along an inlet feed path 46. Full containers 15' are removed from the conveyor 16 along a removal path 47. The full containers may be introduced at the receiving or separating stations 3 for a further sorting and distribution operation.

Figures 15, 15A, 15B, 15C:
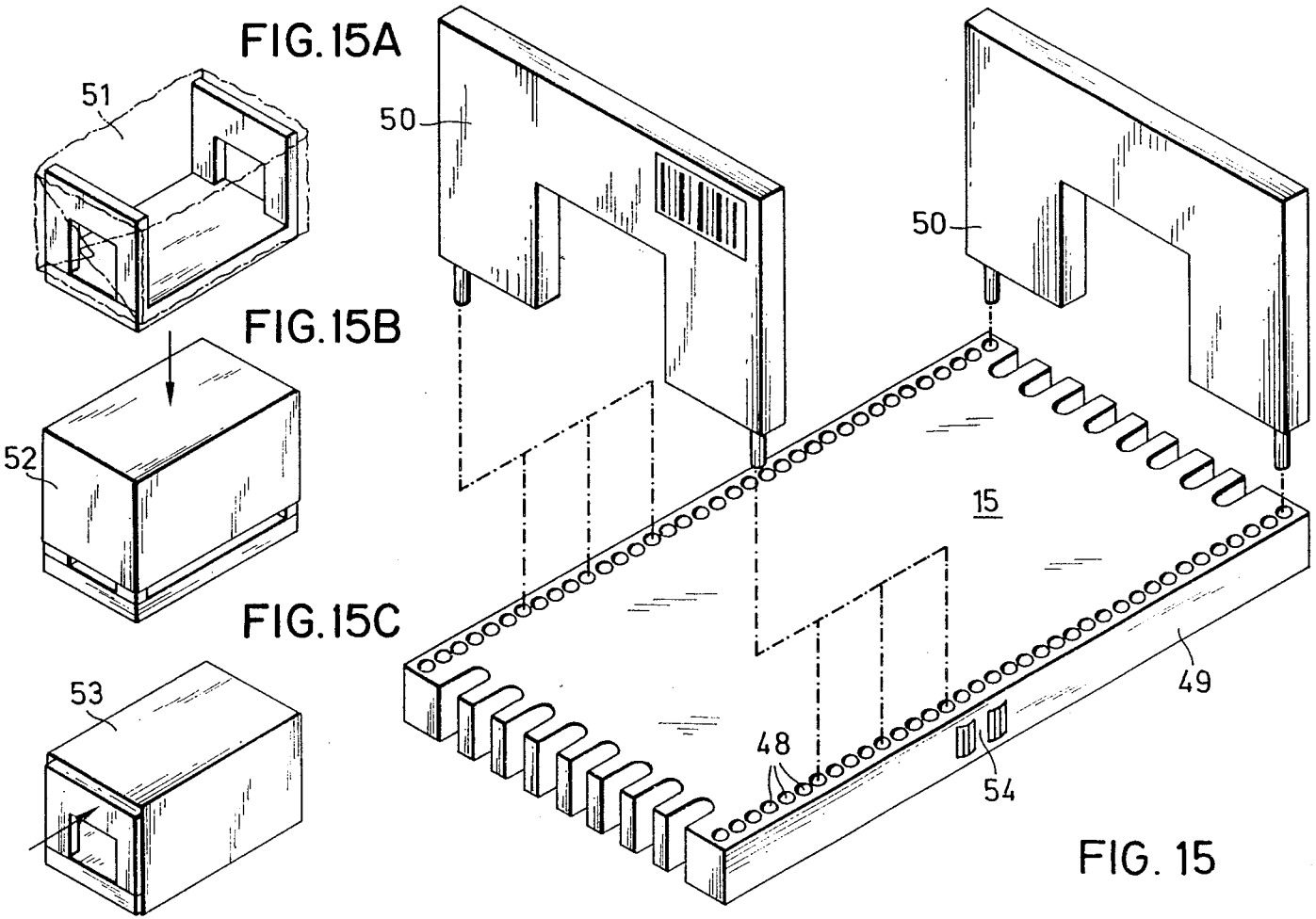
FIG. 15 in the right-hand half is an enlarged view of a possible container for the outlet module, and FIGS. 15A, 15B and 15C display possible container constructions on a reduced scale.

FIG. 15 illustrates a possible contruction of a container 15 for mail pieces. Front and rear sides 50 of the container can be plugged in, as indicated in dash-dot lines in different positions on a base plate 49 containing a plurality of plug-in holes. Such an arrangement, as shown, frequently suffices for holding the mail pieces.

As set forth in FIGS. 15A–15C, respectively, a container 15 can be enclosed with a shrinkage foil 51, with a cover 52 slipped over the container, or with a covering 53. Transporting cams and/or coding cams 54 can be provided along the side of the base plate 49. Additional cams 54 can be used as required.

While specific embodiments of the invention have been shown and described in detail to illustrate the application of the inventive principles, it will be understood that the invention may be embodied otherwise without departing from such principles.

We claim:

1. Apparatus for sorting mail pieces, such as letters and similar mailing pieces of different sizes and thicknesses forwarded as letter mail, for forming accurate mail piece stacks, comprising:

(a) an input module comprising an individual mail piece conveyor and a separating station, a circulating endless transporter conveyor, said individual mail piece conveyor moves past a plurality of spaced tiers of said transporter conveyor, said tiers of said transporter conveyor each comprising a number of individual receptacles, (b) first means on said individual mail piece conveyor for transferring mail pieces from said individual mail piece conveyor into individual receptacles of said transporter conveyor, said first means comprises a plurality of fork-type transporting pallets, said individual receptacles comprise forked baskets, and (c) second means, on an output module, for extracting mail pieces from said receptacles and stacking the mail pieces in containers on said output module.

2. Apparatus, as set forth in claim 1, further comprising means in said apparatus including electronic equipment for determining the destination of individual mail pieces, the position on the transporter conveyor of the mail pieces and for controlling the removal of the individual mail pieces from the transporter conveyor into said containers on said output module.

3. Apparatus, as set forth in claim 2, wherein said separating station includes a device for detecting at least one of the size, thickness and destination of a mail piece at the separating station to be placed on an individual transporting pallet.

4. Apparatus, as set forth in claim 3, wherein said separating station includes a container for different mail pieces to be held in a sloped position, and a device for removing a mail piece from said container including a gripping device and a wiper device for moving an individual mail piece from the container to the transporting pallet.

5. Apparatus, as set forth in claim 4, wherein said gripping device comprises a suction gripper and a mechanical gripper.

6. Apparatus, as set forth in claim 5, wherein said suction gripper comprises a plurality of suction members arranged to be selectively activated and to be supplied with suction power in accordance with information received from a mailing piece format and thickness detection device.

7. Apparatus, as set forth in claim 1, wherein said transporting pallets include a base supporting a forked pallet and said forked pallet comprising a receiving fork for supporting a mail piece.

8. Apparatus, as set forth in claim 7, wherein said receiving fork is mounted on said base and is movable around at least two spaced axes.

9. Apparatus, as set forth in claim 7, wherein said base of said transporting pallets is movable on said individual mail piece conveyor for passage over interconnected conveyor sections and said conveyor sections being arranged substantially horizontally and each conveyor section being assigned to a corresponding horizontal tier of said plurality of spaced tiers of said transporter conveyor.

10. Apparatus, as set forth in claim 1, wherein said individual mail piece conveyor has a synchronization unit for synchronizing the speed of said transporting pallets on said individual mail piece conveyor and the speed of the receptacles on said transporter conveyor and for maintaining the speeds identical.

11. Apparatus, as set forth in claim 1, wherein said first means is arranged to pass said fork-type transporting pallets through said forked baskets for transferring a mail piece from said transporting pallet to said individual receptacle.

12. Apparatus, as set forth in claim 1, wherein said second means is located adjacent to and movable vertically relative to said transporter conveyor.

13. Apparatus, as set forth in claim 12, wherein said second means comprises a wiper fork movable relative to said receptacle on said transporter conveyor for moving upwardly relative to said receptacles for removing the mail piece therefrom.

14. Apparatus, as set forth in claim 13, wherein said containers on said output module are assigned to the wiper fork of at least one said second means for receiving mail pieces from said transporter conveyor.

15. Apparatus, as set forth in claim 14, wherein said containers on said output module are arranged in a sloped position in the region of said wiper fork, and said containers have a rear abutment wall for mail pieces arranged to be displaceable in correspondence with the filling degree of said container.

16. Apparatus, as set forth in claim 13, wherein said second means comprises a plurality of extraction devices located on said output module each with containers for receiving the mailing pieces with said extraction devices being movable vertically relative to said transporter conveyor.

17. Apparatus, as set forth in claim 16, wherein a plurality of said extracting devices arranged to be movable vertically relative to a selected number of said tiers.

18. Apparatus, as set forth in claim 17, wherein said output module comprises an output module conveyor located below said extraction devices with said containers positioned on said output module conveyor and arranged to receive the mail pieces from said extraction devices.

19. Apparatus, as set forth in claim 1, wherein said apparatus is equipped with an electronic data processing system.

20. Apparatus, as set forth in claim 1, wherein said containers on said output module comprise at least one base and plug-in walls upwardly extending from and engageable within said base at selective differences apart.

21. Appratus, as set forth in claim 20, wherein said base includes a plurality of coding means.

22. Apparatus, as set forth in claim 20, wherein said base comprises bar coding fields.

* * * * *